US006860816B2

(12) United States Patent
Bond et al.

(10) Patent No.: US 6,860,816 B2
(45) Date of Patent: Mar. 1, 2005

(54) POCKET BILLIARDS BREAK SHOT TRAINING APPARATUS

(76) Inventors: Charles Raymond Bond, 337 SE. Fenway Pl., Bartlesville, OK (US) 74006; Cameron John Wylie, 14005 20th Pl. West, Lynnwood, WA (US) 98037

( * ) Notice: Subject to any disclaimer, the term of this patent is extended or adjusted under 35 U.S.C. 154(b) by 0 days.

(21) Appl. No.: 10/426,102

(22) Filed: Apr. 29, 2003

(65) Prior Publication Data

US 2004/0043822 A1 Mar. 4, 2004

Related U.S. Application Data

(60) Provisional application No. 60/376,475, filed on Apr. 30, 2002.

(51) Int. Cl.[7] ..... A63D 15/00
(52) U.S. Cl. ..... 473/2; 473/40; D21/782
(58) Field of Search ..... 473/1, 2, 4, 5, 473/14, 17, 19, 52, 53

(56) References Cited

U.S. PATENT DOCUMENTS

| | | | | | |
|---|---|---|---|---|---|
| 2,010,282 | A | * | 8/1935 | Wanncmacher | 473/2 |
| 3,724,849 | A | * | 4/1973 | Pierce | 473/2 |
| 4,183,523 | A | * | 1/1980 | Hecht | 473/40 |
| 4,268,033 | A | * | 5/1981 | Fontaine | 473/2 |
| 5,056,784 | A | * | 10/1991 | Craig | 473/426 |
| 6,364,783 | B1 | * | 4/2002 | Kellogg, Jr. et al. | 473/2 |
| 6,527,647 | B2 | * | 3/2003 | Ringeisen | 473/2 |
| 6,537,156 | B1 | * | 3/2003 | Stagg | 473/40 |
| 6,582,316 | B2 | * | 6/2003 | Tompert | 473/2 |

FOREIGN PATENT DOCUMENTS

| | | | | |
|---|---|---|---|---|
| FR | 2840226 A1 | * | 12/2003 | A63F/7/24 |
| GB | 2234182 A | * | 1/1991 | A63D/15/00 |
| GB | 2239400 A | * | 7/1991 | A63D/15/00 |
| GB | 2258818 A | * | 2/1993 | A63D/15/00 |

* cited by examiner

*Primary Examiner*—Mitra Ayranpour
(74) *Attorney, Agent, or Firm*—Wiley Hollopeter

(57) ABSTRACT

A pocket billiards break shot training apparatus for improving the execution of a break shot. The training apparatus permits a user to make continuously repeated break shots without the time consuming necessity of gathering and re-racking the object balls after each shot. Moreover, the training apparatus permits a user to increase skill in controlling post break, cue ball positioning. The apparatus employs a head ball, rear ball, and two side balls oriented around cross-shaped frame to simulate a racked set of balls. Furthermore, the apparatus utilizes the compression of a spring element to sufficiently simulate the actual reaction of a set of racked balls to the impact of a cue ball. A bow restraint assembly interacts with a set of elastic cords to moor the frame in a desirable position on the table and reposition the frame after each shot.

20 Claims, 6 Drawing Sheets

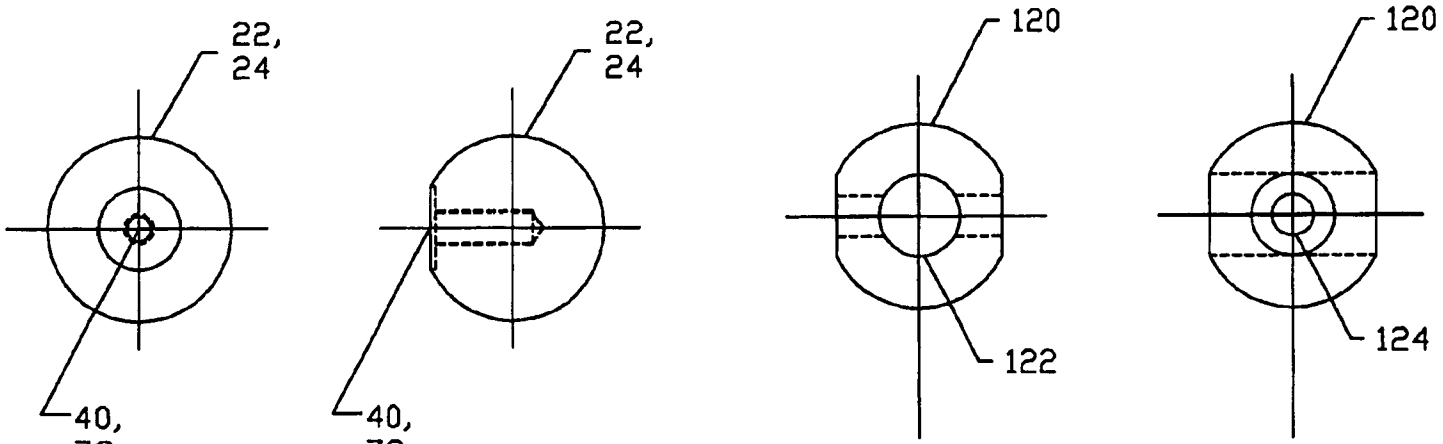
Figure 4A
Figure 4B
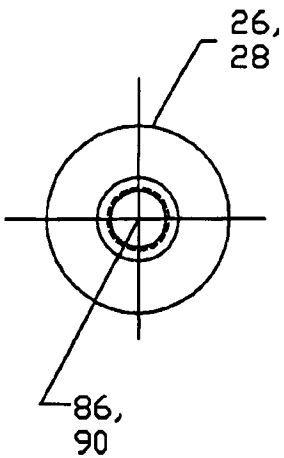
Figure 4C

POCKET BILLIARDS BREAK SHOT TRAINING APPARATUS

This application claims the benefit of U.S. Provisional Application No. 60/376,475, filed Apr. 30, 2002.

BACKGROUND OF THE INVENTION

1. Field of the Invention

The present invention relates to a training apparatus for use in connection with enhancing skill at pocket billiards. The training apparatus has particular utility in connection with simulating a racked set of balls on a pocket billiards table. More specifically, the training apparatus is used in a practice session to enhance the skill level of players wishing to improve their break shot.

2. Description of the Prior Art

Pocket billiards training apparatuses are desirable for enhancing the skill level of pocket billiards players. In fact, a variety of aids are available to help a player improve a variety of shots encountered in a pocket billiards game. However, the available aids do not allow a player to efficiently practice a break shot.

A break shot is the opening shot of a pocket billiards game, involving a cue ball and a plurality of object balls. To set up a break shot, the object balls are racked in a frame in the center of the table and arranged in a geometric angular pattern as called for in the rules of the game. During the break shot, the game commences with the cue ball being struck by the first contestant. The cue ball is directed toward the head object ball in such a manner that the impact of the cue ball causes the object balls to scatter over the area of the table. If one or more object balls enter a pocket during the break shot, the first contestant proceeds to attempt to shoot the remaining balls into the pocket under the rules of the game.

It has been universally agreed upon and demonstrated in the past that the break shot is of prime importance to the first contestant. If the break shot is executed with sufficient skill, the object balls will be efficiently scattered and the cue ball will be left in a favorable position. Frequently, a highly skilled contestant left with efficiently scattered object balls and a favorably positioned cue ball may win the game by shooting the entire range of object balls into the pockets. Thus, the faculty of making an excellent break shot is emphatic. Furthermore, there is a need for a pocket billiards training apparatus that enhances the skill level of players wishing to improve their break shot.

The use of pocket billiards training devices is known in the prior art. For example, U.S. Pat. No. 6,527,647 to Robert W. Ringeisen discloses a training device that assists the user in focusing upon the correct strike points on both the cue ball and the object ball. However, the Ringeisen '647 patent does not simulate a racked set of balls used during a break shot. The Ringeisen '647 patent has a further drawback of requiring the user to reposition the balls after each practice shot. In other words, the Ringeisen '647 device is inefficient because practice time is wasted setting up each shot.

U.S. Pat. No. 6,364,783 to Jack V. Kellogg discloses a practice billiard aiming system that is useful in teaching and practicing pocket billiards. However, the Kellogg '783 patent does not permit effective simulation of a break shot. Additionally, the Kellogg '783 invention utilizes balls with aiming line markings. This is a drawback because the marked balls prohibit training under regulation game conditions.

While the above-described devices fulfill their respective, particular objectives and requirements, the aforementioned patents do not describe a pocket billiards training apparatus that simulates a racked set of balls for use in a practice session to enhance the skill level of players wishing to improve their break shot. Neither the Ringeisen '647 nor the Kellogg '783 patent makes a provision for simulating the break shot setup. Moreover, neither patent discloses an invention that promotes efficient practice by automatically repositioning itself after each practice shot.

Therefore, a need exists for a new pocket billiards training apparatus that simulates a racked set of balls for use in a practice session to enhance the skill level of players wishing to improve their break shot. In this regard, the present invention substantially fulfills this need. In this respect, the pocket billiards break shot training apparatus according to the present invention substantially departs from the conventional concepts and designs of the prior art, and in doing so provides an apparatus primarily developed for the purpose of enhancing a players break shot.

SUMMARY OF THE INVENTION

In view of the foregoing disadvantages inherent in the known types of billiards training aids now present in the prior art, the present invention provides a new pocket billiards break shot training apparatus, and overcomes the above-mentioned disadvantages and drawbacks of the prior art. As such, the general purpose of the present invention, which will be described subsequently in greater detail, is to provide a new pocket billiards break shot training apparatus that has all the advantages of the prior art mentioned heretofore and many novel features that result in a pocket billiards training aid that is not anticipated, rendered obvious, suggested, or even implied by the prior art, either alone or in any combination thereof.

To attain this, the present invention essentially comprises a cross-shaped frame, an energy absorbing assembly, a plurality of balls, a bow restraint assembly, and a set of elastic restraint cords. The cross-shaped frame simulates a rack of pocket billiards balls that would be used in an actual game. Furthermore, the cross-shaped frame is moored in the center of the table to achieve the function of a training apparatus that can be used to enhance a player's break shot through repetitive practice.

To facilitate simulation of a break shot, the apparatus incorporates a head ball in the equivalent position to that of an actual rack of balls. The head ball is situated toward the player and carries a numeral "1" on the front view. Thus, in the same manner as in an actual pocket billiards game, the head ball becomes the player's aiming point In conjunction with the head ball, a set of side balls and a rear ball form the four ends of the cross-shaped frame. A center ball is positioned in the center of the frame for decorative purposes. Each ball is similar to a regulation billiards ball. Moreover, the side balls and rear ball are black.

In order to simulate a cue ball striking the head ball in an actual game of pocket billiards, the frame incorporates an energy absorbing assembly. The energy absorbing assembly comprises a bolt, an alignment cartridge, a spacer, and a cylindrical spring. The head ball is screwed to the metal bolt, which has a tapered socket head protruding to the rear. Furthermore, the metal bolt passes through a bronze alignment cartridge that has a tapered bore to allow the bolt to sag or deflect laterally when the head ball is struck off center. The bolt's tapered socket head mates with a corresponding seat in the alignment cartridge that realigns the bolt and the head ball to a central alignment after the impact of each shot.

The alignment cartridge has an external thread which mates with a corresponding internal thread in the cross-shaped frame's main shaft. Between the alignment cartridge and the head ball, the bolt passes through the cylindrical spring that may be constructed of metal or a solid elastomeric material. Furthermore, the bolt is threaded through a round metal spacer. After passing through the alignment cartridge and spacer, the bolt is threaded into the head ball. The bolt is tightened to a specific, preload torque setting, which compresses the spring between the alignment cartridge and the spacer. The alignment cartridge is then threaded into the main shaft.

In addition to the head ball energy absorbing assembly, the pocket billiards break shot training apparatus includes a bow restraint assembly. The bow restraint assembly is constructed of two fiberglass rods that are connected to a plastic joining rod by insertion into a set of hole sockets. The fiberglass rods are then bent to form an arc and positioned in the cavity below each side rail cushion and the end rail cushion of a pocket billiards table. This provides a point on each side of the pocket billiards table to anchor the elastic restraint cords. By adjusting the lengths of the fiberglass rods, the bow restraint assembly may be adapted to fit billiards tables of varying lengths and widths. Furthermore, by adjusting the tension of the restraint cords the training apparatus is moored into the center of the table. Thus, the entire assembly can be quickly installed for practice and conveniently removed to restore playing availability to the table.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new pocket billiards break shot training apparatus that has all of the advantages of the prior art pocket billiards training aids and none of the disadvantages.

It is another object of the present invention to provide a new pocket billiards break shot training apparatus that may be easily and efficiently manufactured and marketed.

Still another object of the present invention is to provide a pocket billiards break shot training apparatus that simulates a racked set of balls on a pocket billiards table. This allows a player to participate in a practice session to enhance his or her break shot skill level.

Another object of the present invention is to provide a pocket billiards break shot training apparatus that permits a user to increase skill in controlling post break, cue ball positioning.

Lastly, it is an object of the present invention to provide a new pocket billiards break shot training apparatus that repositions itself after each shot. This permits a player to practice his or her break shot efficiently without continually gathering and re-racking the object balls.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 4A, 4B, and 4C are right side and front elevational views of the training apparatus' head, rear, and side balls, respectively.

DESCRIPTION OF THE PREFERRED EMBODIMENT

Figure 1:
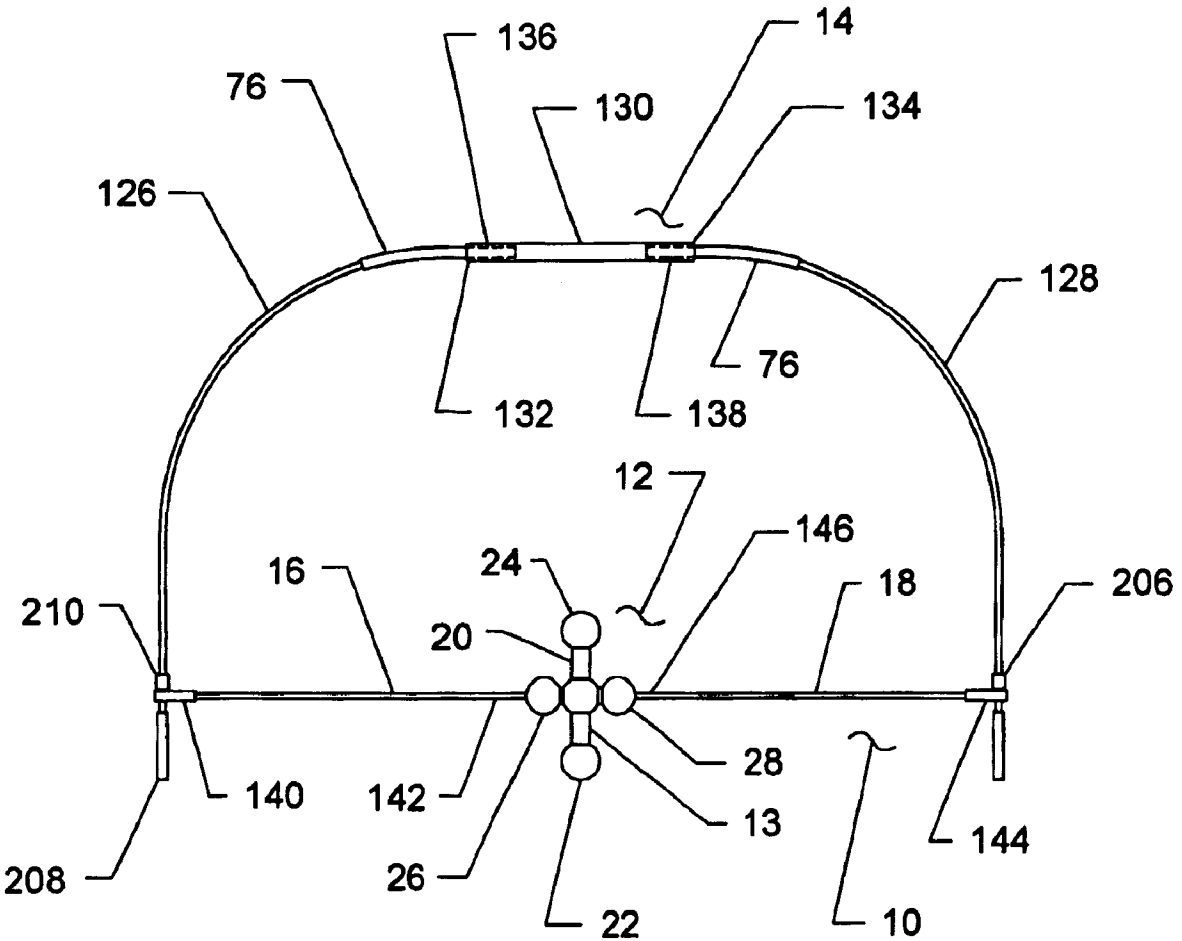
FIG. 1 is a top plan view of the preferred embodiment of the pocket billiards break shot training apparatus constructed in accordance with the principles of the present invention.

Referring now to the drawings, and particularly to FIGS. 1–6, a preferred embodiment of the pocket billiards break shot training apparatus of the present invention is shown and generally designated by the reference numeral 10. In FIG. 1, a new pocket billiards break shot training apparatus 10 of the present invention for use in a practice session to simulate a break shot is illustrated and will be described. More particularly, the pocket billiards break shot training apparatus 10 has a cross-shaped frame 12, a plurality of balls, an energy absorbing assembly 13, a bow restraint assembly 14, a first restraint cord 16, and a second restraint cord 18.

Figure 2:
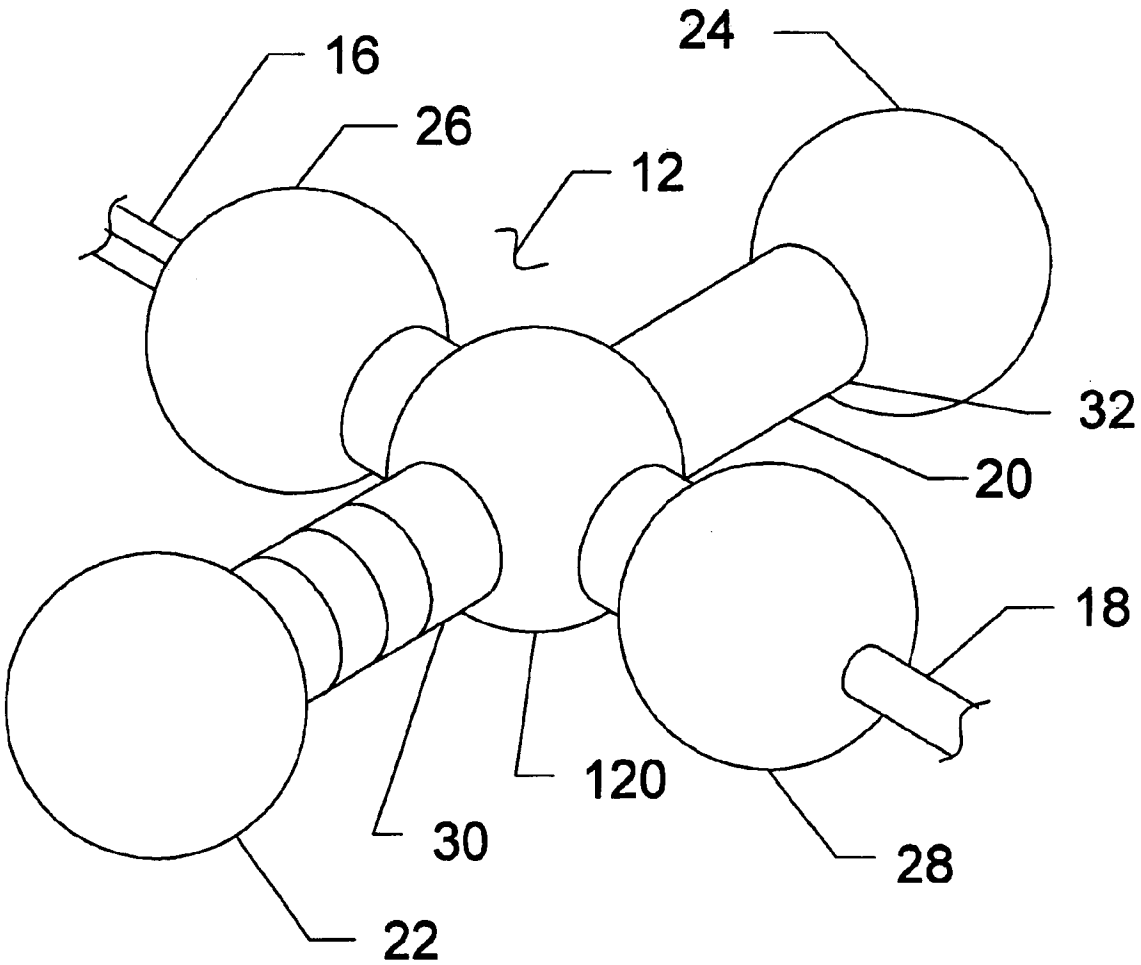
FIG. 2 is a front perspective view (from above) of the training apparatus' cross-shaped frame.
Figures 3A, 3B:
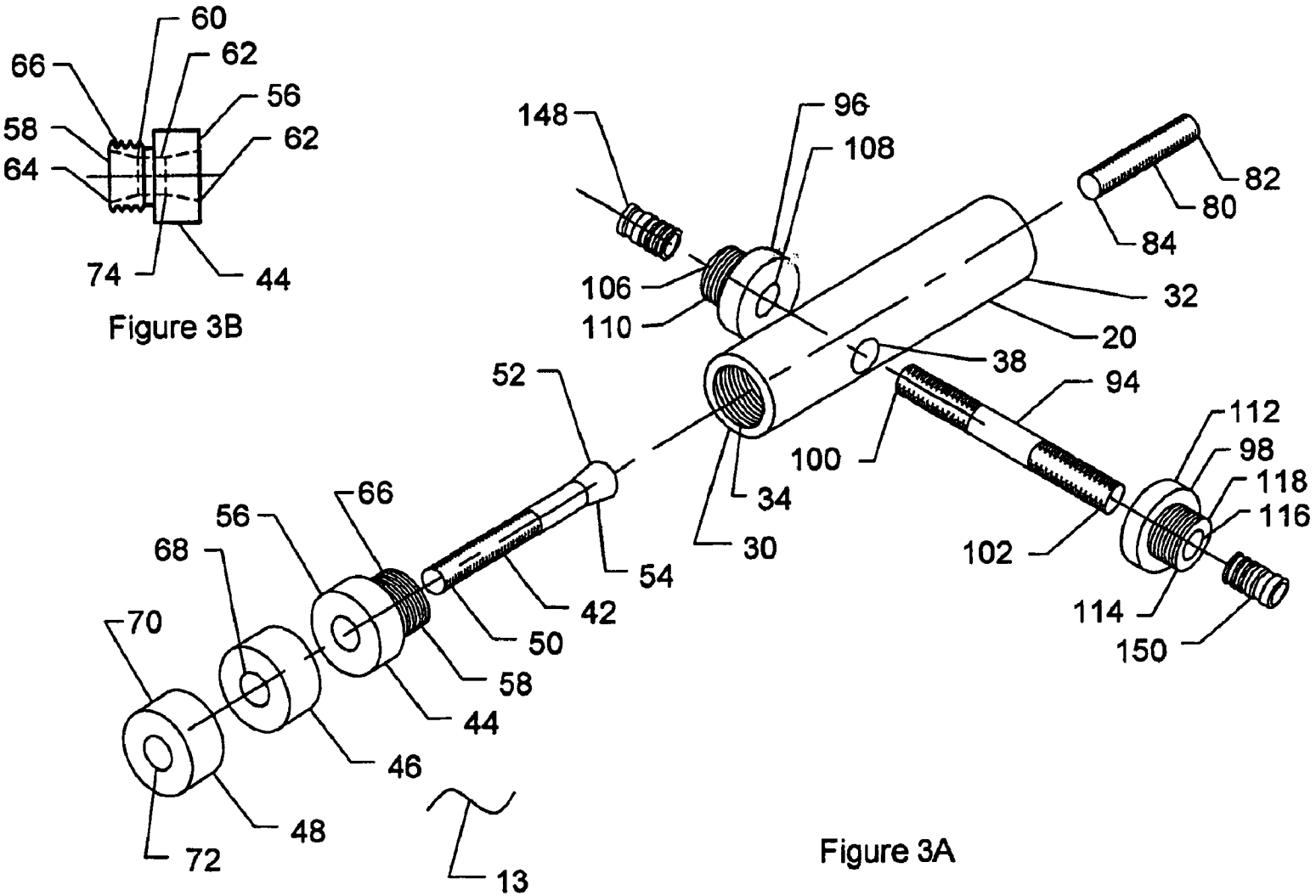
FIG. 3A is an exploded view of the training apparatus' cross-shaped frame.
FIG. 3B is a left side view of the apparatus' alignment cartridge.

FIG. 2 further illustrates the apparatus' cross-shaped frame 12. As shown in FIG. 2, the cross-shaped frame comprises a main shaft 20 and a lateral shaft 94. FIG. 3A better illustrates the intricacies of the main shaft 20. The main shaft 20 is an elongated rod with a first end 30 and a second end 32. The main shaft's first end 30 defines a first threaded receptacle 34 therein. Furthermore, the main shaft's second end 32 defines a second threaded receptacle 36 therein. Each bolt receptacle 34, 36 is a bore in the end of the main shaft designed for threadable reception of a piece having external threads. A lateral bore 38 extends perpendicularly through the main shaft 20. Moreover, the lateral bore 38 is located between the first threaded receptacle 34 and the second threaded receptacle 36. The lateral shaft 94 is a threaded stud that has a first end 100 and a second end 102. More specifically, the lateral shaft 94 is shaped and dimensioned for slidable insertion through the main shaft's lateral bore 38.

In addition to the cross-shaped frame 12, the pocket billiards break shot training apparatus 10 comprises a plurality of balls. The preferred embodiment has a head ball 22, a rear ball 24, a first side ball 26, a second side ball 28, and a center ball 120. As illustrated in FIG. 4A, the head ball 22 has a generally spherical outer surface and defines a threaded bolt receptacle 40 therein. Similarly, the rear ball 24 has a generally spherical outer surface and defines a threaded stud receptacle 78. Each bolt receptacle 40, 78 is a bore in the ball designed for threadable reception of a piece having external threads.

FIG. 4C shows the first 26 and second 28 side balls. Each ball 26, 28 has a generally spherical outer surface. The first side ball 26 defines a spacer receptacle 86 therein. Additionally, the first side ball 26 defines a bore 88 therethrough, extending from the spacer receptacle 86 to the outer surface at a point opposite the spacer receptacle 86. Similarly, the second side ball 28 defines a spacer receptacle 90 therein. Moreover, the second side ball defines a bore 92 therethrough, extending from the spacer receptacle 90 to the outer surface at point opposite the spacer receptacle 90. Each bolt receptacle 86, 90 is a bore in the ball designed for threadable reception of a piece having external threads.

As shown in FIG. 4B, the center ball 120 has a generally spherical outer surface and defines a first bore 122 therethrough. Additionally, the center ball 120 defines a second bore 124 extending therethrough and aligned perpendicular to the first bore 122. The first bore 122 is shaped and dimensioned for slidable reception of the main shaft 20. On the other hand, the second bore 124 is shaped and dimensioned for slidable reception of the lateral shaft 94.

In order to simulate a cue ball striking the head ball 22 in an actual game of pocket billiards, an energy absorbing assembly 13 is positioned between the cross-shaped frame 12 and the head ball 22. FIG. 3A better illustrates the energy absorbing assembly 13 that connects the head ball 22 to the main shaft's first end 30. The energy absorbing assembly 13 comprises a bolt 42, an alignment cartridge 44, a cylindrical spring 46, and a spacer 48. More specifically, the bolt 42 has a first end 50 and a second end 52. The bolt's first end 50 is shaped and dimensioned for threadable insertion into the head ball's threaded bolt receptacle 40. The bolt's second end 52 defines a tapered socket head 54.

In addition to the bolt 42, the alignment cartridge 44 shown in FIG. 3B is an integral part of the energy absorbing assembly 13. The alignment cartridge 44 has a first end 56 and a second end 58. Furthermore, the alignment cartridge defines a tapered bore 60 that extends from a first diameter 62 located at the first end 56 to a second diameter 64 located at the second end 58. Moreover, the tapered bore 60 defines a third diameter 74 between the first 62 and second 64 diameters. The first diameter 62 is smaller than the second diameter 64 and the third diameter 74 is smaller than the first diameter 62. Furthermore, the alignment cartridge's tapered bore 60 is shaped and dimensioned for slidable reception of the bolt's first end 50. The alignment cartridge's second end 58 defines a set of external threads 66. Moreover, the external threads 66 are shaped and dimensioned for threadable insertion into the main shaft's first threaded receptacle 34.

The cylindrical spring 46 and spacer 48 interact with the bolt 42 and alignment cartridge 44 to form the energy absorbing assembly 13. The cylindrical spring 46 defines a bore 66 extending therethrough. The cylindrical spring's bore 66 is shaped and dimensioned for slidable reception of the bolt's first end 50. The spacer 48 has an exterior surface 70 and defines a threaded bore 72 therethrough. The spacer's threaded bore 72 is shaped and dimensioned for threadable reception of the bolt's first end 50.

The head ball 22 connects to the bolt 42 by traversing the bolt's first end 50 through the alignment cartridge's tapered bore 60 from the cartridge's second end 58 to the cartridge's first end 56, traversing the bolt's first end 50 through the cylindrical spring's bore 66, threading the bolt's first end 50 through the spacer's threaded bore 72, and threading the bolt's first end 50 into the head ball's threaded bolt receptacle 40. After connecting the bolt 42 to the head ball 22, the alignment cartridge's external threads 66 are threaded into the main shaft's first threaded receptacle 34, securing the energy absorbing assembly 13 to the main shaft's first end 30.

Figure 5:
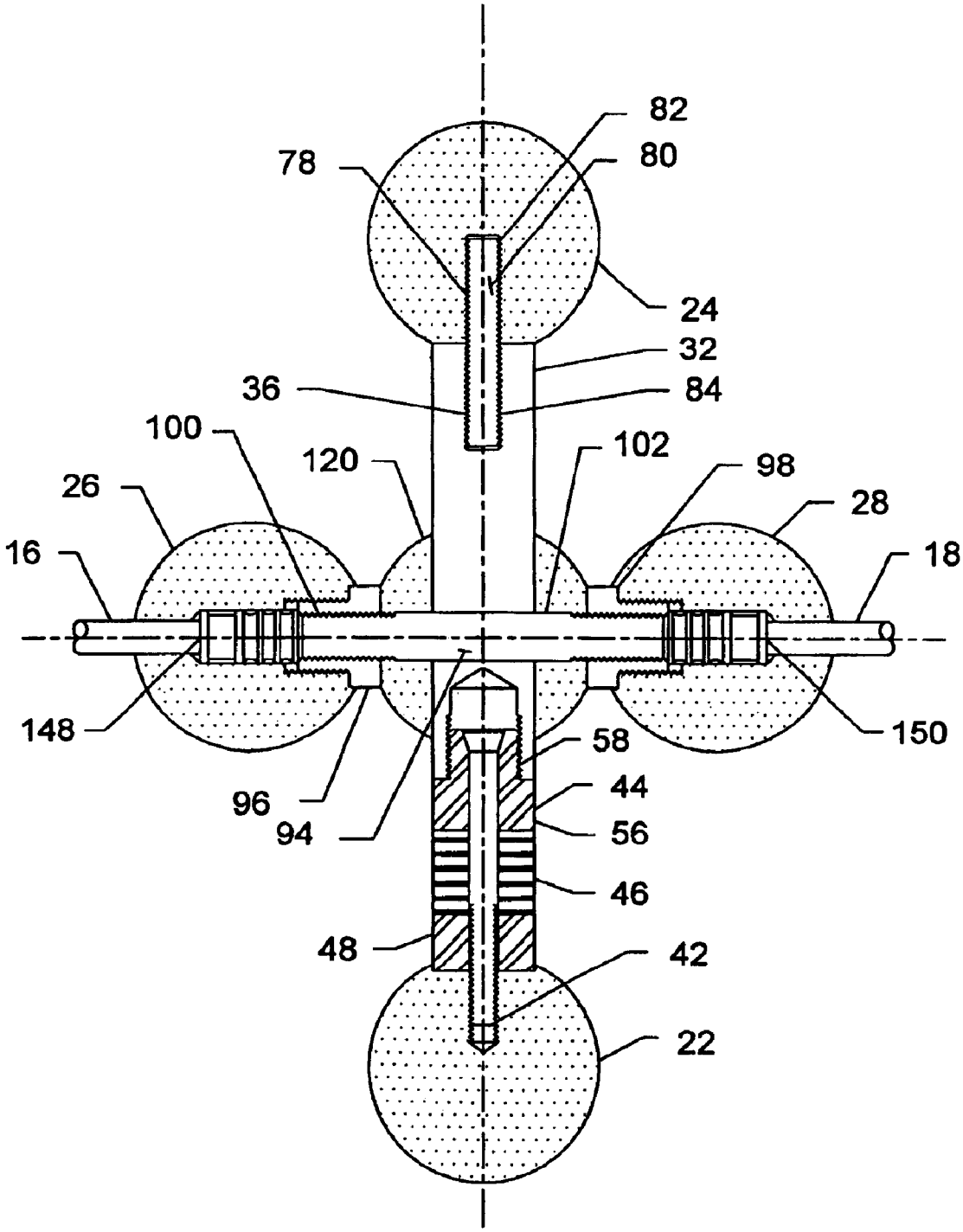
FIG. 5 is a cross-sectional view of the training apparatus' cross-shaped frame.

The rear ball is integrally attached to the main shaft 12. FIG. 5 best illustrates the connection between the rear ball 24 and the main shaft's second end 32. Generally, a threaded stud 80 connects the rear ball 24 to the main shaft's second end 32. More specifically, the threaded stud 80 has a first end 82 that is shaped and dimensioned for threadable insertion into the rear ball's threaded stud receptacle 78. Moreover, the threaded stud 80 has a second end 84 that is shaped and dimensioned for threadable insertion into the main shaft's second threaded receptacle 36. Thus, the rear ball 24 and the main shaft's second end 32 are connected by threading the stud's first end 82 into the rear ball 24 and threading the stud's second end 84 into the main shaft's second end 32.

The first 26 and second 28 side balls are attached to the lateral shaft 94. FIG. 5 best illustrates the connection between the first 26 and the second 28 side balls and the lateral shaft 94. The connection comprises a first spacer nut 96, and a second spacer nut 98. The first spacer nut 96 has a first end and a second end. Furthermore, the first spacer nut 96 defines a threaded shaft receptacle 108 therein. The first spacer nut's shaft receptacle 108 is shaped and dimensioned for threadable reception of the lateral shaft's first end 100. The first spacer nut's second end defines a set of external threads 110 that are shaped and dimensioned for threadable insertion into the first side ball's spacer receptacle 86. Thus, the first side ball 26 is attached to the lateral shaft's first end 100 by threading the first spacer nut's external threads 110 into the first side ball's spacer receptacle 86 and threading the lateral shaft's first end 100 into the first spacer nut's shaft receptacle 108.

Similarly, the second spacer nut 98 has a first end 112 and a second end 114. The second spacer nut 98 defines a threaded shaft receptacle 116. The second spacer nut's shaft receptacle 116 is shaped and dimensioned for threadable reception of the lateral shaft's second end 102. The second spacer nut's second end 114 defines a set of external threads 118 that are shaped and dimensioned for threadable insertion into the second side ball's spacer receptacle 90. Thus, the second side ball 28 is attached to the lateral shaft's second end 102 by threading the second spacer nut's external threads 118 into the second side ball's spacer receptacle 90 and threading the lateral shaft's second end 102 into the second spacer nut's shaft receptacle 116.

In the preferred embodiment, a center ball 120 is positioned between the first spacer nut 96 and the second spacer nut 98. More particularly, the main shaft 20 passes through the center ball's first bore 122. Additionally, the lateral shaft 94 passes through center ball's second bore 124.

In addition to the cross-shaped frame 12 and energy absorbing assembly 13, the pocket billiards break shot training apparatus 10 comprises a bow restraint assembly 14. FIG. 1 best illustrates the bow restraint assembly 14. The bow restraint assembly 14 further comprises a first rod 126, a second rod 128, and a joining rod 130. Each rod 126, 128, and 130 is shaped and dimensioned to fit into the cavity between the rail cushion and surface of a pocket billiards table. Furthermore, the first rod 126 defines a bore therethrough. Similarly, the second rod 128 defines a bore therethrough. In the preferred embodiment, the first 126 and second rods 128 are constructed of a flexible, fiberglass-blended polymer.

The joining rod 130 has a first end 132 and a second end 134. Moreover, the first end 132 defines a first rod receptacle 136 that is shaped and dimensioned for slidable reception of the first rod 126. Similarly, the second end 134 defines a second rod receptacle 138 that is shaped and dimensioned for slidable reception of the second rod 128. In the preferred embodiment, the joining rod is constructed of a durable, rigid plastic. Moreover the joining rod 130 may be constructed in different lengths to facilitate use on various table sizes. More particularly, use on seven foot, eight foot, or nine foot tables.

A flexible, fiberglass stabilizing tube 76 may be used to strengthen the stress points on the first 126 and second 128 rods. Each stabilizing tube 76 defines a bore therethrough that is shaped and dimensioned for slidable reception of either the first 126 or second 128 rod. In use, the first rod 126 is slid into a stabilizing tube 76 and then slid into the joining rod's first rod receptacle 136. Similarly, the second rod 128 is slid into a stabilizing tube 76 and then slid into the joining rod's second receptacle 138.

To facilitate use on different sized tables, the first 126 and second 128 rods are equipped with an adjustable extension assembly 206. Each extension assembly 206 permits the length of either the first 126 or second 128 rod to be adjusted to fit any billiards table. The extension assembly 206 comprises an extension rod 208 and a fastening member 210. The extension rod 208 is shaped and dimensioned for slidable insertion into and out of either the first 126 or second 128 rod's bore. When the fastening member 210 is loosened, the extension rod 208 may be repositioned by sliding it to a desired length. Tightening the fastening member 210 locks the extension rod 208 at the desired length.

The pocket billiards break shot training apparatus 10 further comprises a first restraint cord 16 and a second restraint cord 18. The first restraint cord 16 has a first end 140 and a second end 142. The first end 140 is removably attached to the first rod 126 opposite the joining rod 130. As illustrated in FIG. 5, the second end 142 extends through the first side ball's bore 88 and attaches to a lag bolt anchor 148. Similarly, the second restraint cord 18 has a first end 144 and a second end 146. The first end 144 is removably attached to the second rod 128 opposite the joining rod 130. The second end 146 extends through the second side ball's bore 92 and attaches to a lag bolt anchor 150.

While a preferred embodiment of the pocket billiards break shot training apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Figure 6:
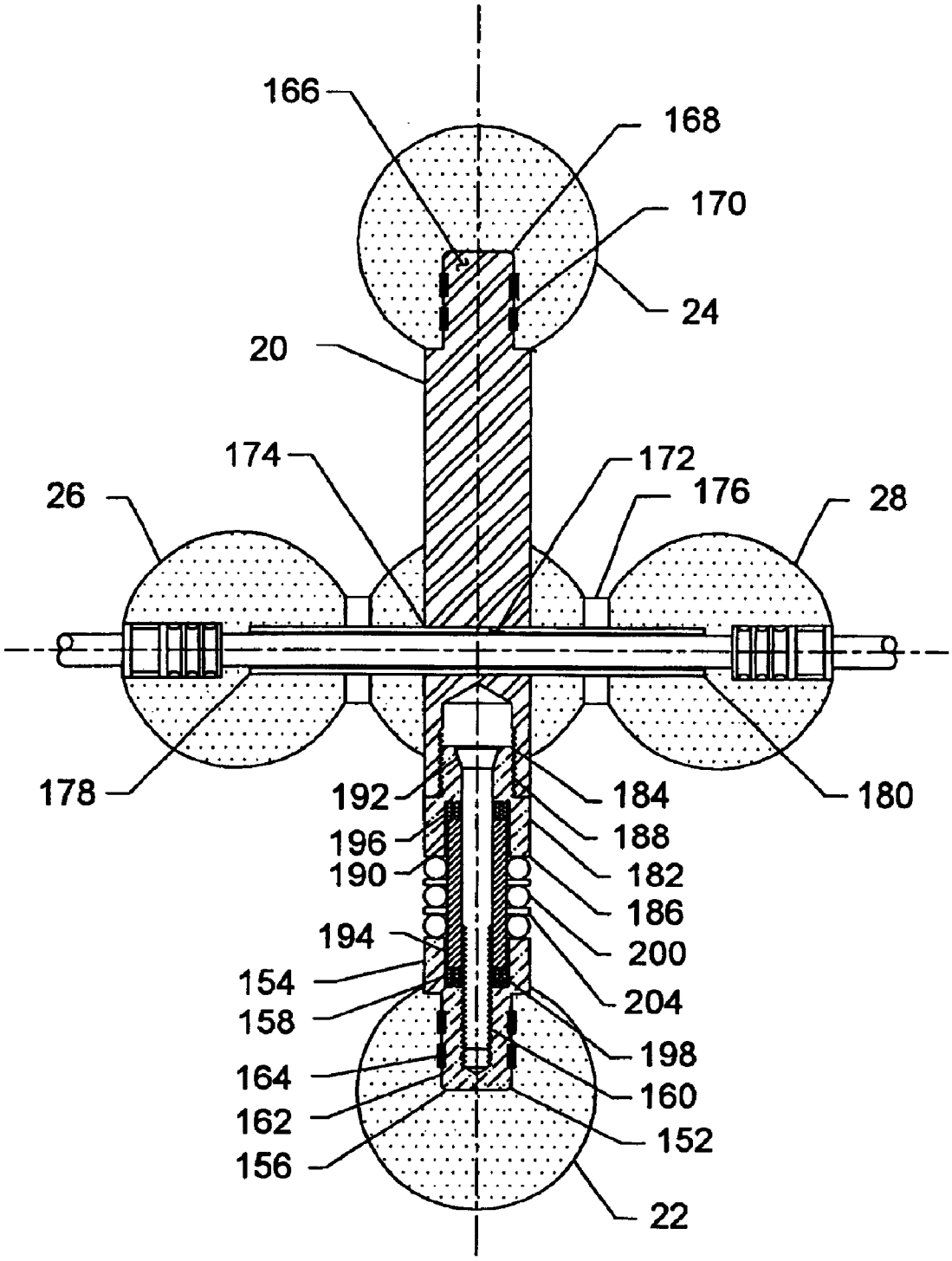
FIG. 6 is a cross-sectional view of an alternative embodiment of the pocket billiards break shot training apparatus of the present invention. The same reference numerals refer to the same parts throughout the various figures.

For example, FIG. 6 illustrates an alternative embodiment of the cross-shaped frame 12. Rather than attaching the balls by threading them to an adjacent piece, the alternative embodiment employs adhesive to connect the front 22 and rear 24 balls to the cross-shaped frame 12. As shown in FIG. 6, the alternative embodiment has a head nose piece 152 that connects to the head ball 22. The head nose piece 152 has a first end 154 and a second end 156. The first end 154 defines a barrel receptacle 158 therein. The barrel receptacle 158 is a bore in the head nose piece's first end 154 that is designed for slidable reception of a tube-shaped piece. Additionally, the head nose piece 152 defines a threaded bore 160 therethrough, extending from the first end 154 to the second end 156. In order to receive the head nose piece 152, the head ball 22 defines a nose piece receptacle 162 therein instead of a threaded bolt receptacle 40 as described in the previous embodiment. The nose piece receptacle 162 is shaped and dimensioned for slidable insertion of the head nose piece 152. An adhesive 164 bonds the head nose piece 152 inside the nose piece receptacle 162.

In this embodiment, the main shaft's second end 32 defines a rear nose piece 166 rather than a second threaded receptacle 36. Furthermore, the rear ball 24 defines a nose piece receptacle 168 rather than a threaded stud receptacle 78. The nose piece receptacle 168 is shaped and dimensioned for slidable reception of the rear nose piece 166. An adhesive 170 bonds the rear nose piece 166 inside the nose piece receptacle 168.

In addition to adhesively attaching the head 22 and rear 24 balls, the alternative embodiment utilizes tension to hold the first 26 and second 28 side balls in position. As shown in FIG. 6, the alternative embodiment's lateral shaft 94 is an elongated tube 172. The elongated tube 172 defines a bore 174 extending therethrough and is shaped and dimensioned for slidable insertion into the main shaft's lateral bore 38. Furthermore, the elongated tube's bore 174 is shaped and dimensioned for slidable reception of a restraint cord 16. In this embodiment, the first spacer nut 96 and the second spacer nut 98 are each replaced with a ball spacer 176. Each ball spacer 176 is a washer-shaped piece defining an aperture therein.

To incorporate reception of the elongated tube 172, the first side ball 26 defines a bore 178 therethrough rather than a spacer receptacle 86. Similarly, the second side ball 28 defines a bore therethrough 180 rather than a spacer receptacle 90. The side ball bores 178, 180 are shaped and dimensioned for slidable reception of the elongated tube 172. More particularly, the elongated tube 172 transverses the first side ball's bore 178, transverses a spacer 176, transverses the main shaft's lateral bore 38, transverses a second spacer 176, and transverses the second side ball's bore 180. In use a restraint cord 16 attaches to the bow restraint assembly's first rod 126, transverses the elongated tube 172, and attaches to the bow restraint assembly's second rod 128. A lag bolt anchor 148 located in the first side ball 26 and a lag bolt anchor 150 located in the second side ball 28 place a desired amount of tension on the restraint cord 16 to hold the side balls 26, 28 and the spacers 176 in place.

In addition to the use of an adhesive and tension to replace the threaded ball connections, the alternative embodiment utilizes a solid elastomeric material to absorb the head ball's 22 energy rather than the cylindrical spring 46. In this embodiment, the energy absorbing assembly comprises a barrel cartridge 182, the head nose piece 152, a barrel 194, a first washer 196, a second washer 198, a set of three o-rings 200, and a set of four backup rings 204. The barrel cartridge 182 replaces the alignment cartridge 44 and the head nose piece 152 acts as the spacer 48. The barrel cartridge 182 has a first end 184 and a second end 186. The first end 184 defines a set of external threads 188 that are shaped and dimensioned for threadable insertion into the main shaft's first threaded receptacle 34. The barrel cartridge's second end 186 defines a barrel receptacle 190. Additionally, the barrel cartridge 182 defines a tapered bore 192 therethrough, extending from the first end 184 to the second end 186. More particularly, the barrel cartridge's tapered bore 192 extends from a first diameter at the first end 184 to a second diameter at the barrel receptacle 190. The first diameter is larger than the second diameter. Furthermore, the barrel cartridge's tapered bore 192 is shaped and dimensioned for slidable reception of the bolt's first end 50.

The tube-shaped barrel 194 defines a bore extending therethrough. Moreover, the barrel 194 is shaped and dimensioned for slidable insertion into the head nose piece's barrel receptacle 158 and the barrel cartridge's barrel receptacle 190. The first washer 196 is shaped and dimensioned for slidable reception of the bolt 42 and slidable insertion into the barrel cartridge's barrel receptacle 190. Similarly, the second washer 198 is shaped and dimensioned for slidable reception of the bolt 42 and slidable insertion into the head nose piece's barrel receptacle 158. The o-rings 200 are shaped and dimensioned to fit semi-loosely over the barrel 194. Similarly, the backup rings 204 are shaped and dimensioned to fit semi-loosely over the barrel 194. In use, the o-rings 200 and backup rings 204 are positioned on the barrel 194 in an alternating pattern. In other words, there is an o-ring 200 between each backup ring 204.

The alternative embodiment of the energy absorbing portion connects together by placing the second washer 198 in the head nose piece's barrel receptacle 158, placing the barrel 194 into the head nose piece's barrel receptacle 158, sliding the o-rings 200 and backup rings 204 over the barrel 194, sliding the first washer 196 into the barrel cartridge's barrel receptacle 190, and sliding the exposed end of the barrel 194 into the barrel cartridge's barrel receptacle 190. After positioning the barrel cartridge 182, the assembly is completed by sliding the bolt's first end 50 through the barrel cartridge's bore 192 from the first end 184 to the second end 186, sliding the bolt 42 through the first washer 196, sliding the bolt 42 through the barrel's bore, sliding the bolt 42 through the second washer 198, and threading the bolt 42 into the head nose piece's threaded bore 160. Next, the barrel cartridge 182 is connected to the main shaft 20 by threading the barrel cartridge's external threads 188 into the main shaft's first threaded receptacle 34.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pocket billiards break shot training apparatus comprising:

a cross-shaped frame having a main shaft and a lateral shaft, said main shaft having a first end and a second end and defining a lateral bore therethrough, and said lateral shaft having a first end and a second end and extending through said main shaft's lateral bore;

an energy absorbing assembly, said energy absorbing assembly being removably attached to said main shaft's first end;

a head ball having a generally spherical outer surface, said head ball being integrally attached to said energy absorbing assembly, opposite said main shaft;

a rear ball having a generally spherical outer surface, said rear ball being integrally attached to said main shaft's second end;

a first side ball having a generally spherical outer surface, said first side ball being integrally attached to said lateral shaft's first end;

a second side ball having a generally spherical outer surface, said second side ball being integrally attached to said lateral shaft's second end;

a bow restraint assembly;

a first restraining cord, said first restraining cord being removably attached to said bow restraint assembly and integrally attached to said first side ball; and a second restraining cord, said first restraining cord being removably attached to said bow restraint assembly opposite said first restraining cord, and said second restraining cord being integrally attached to said second side ball.

2. The pocket billiards break shot training apparatus of claim 1 further comprising:

a center ball having a generally spherical shape and defining a first bore and second bore therethrough, said first bore surrounding said main shaft between said main shaft's first and second ends, and said second bore surrounding said lateral shaft between said lateral shaft's first and second ends.

3. The pocket billiards break shot training apparatus of claim 1 wherein said head ball is yellow and carries the numeral "1" and said rear, first side, and second side balls are black.

4. The pocket billiards break shot training apparatus of claim 1 wherein said energy absorbing assembly comprises:

an alignment cartridge having a first end and second end and defining a tapered bore therethrough, said tapered bore having a first diameter at said first end and a second diameter at said second end, said tapered bore having a third diameter between said first and second diameters, said first diameter being smaller than said second diameter, said third diameter being smaller than said first diameter, and said second end being removably attached to said main shaft's first end;

a spacer defining a threaded bore therethrough, said spacer's bore being aligned in the same plane with said alignment cartridge's tapered bore;

a cylindrical spring having a first end and a second end and defining a bore therethrough, said cylindrical spring's bore being aligned in the same plane with said spacer's bore, said cylindrical spring's first end being adjacent to said spacer, and said cylindrical spring's second end being adjacent to said alignment cartridge's first end; and a bolt having a first end and second end, said bolt traversing said spacer's bore, cylindrical spring's bore, and said alignment cartridge's tapered bore, and said bolt's first end being attached to said head ball.

5. The pocket billiards break shot training apparatus of claim 1 wherein said energy absorbing assembly comprises:

a barrel cartridge having a first end and second end and defining a tapered bore therethrough, said bore having a first diameter at said first end and a second diameter at said second end, said first diameter being smaller than said second diameter, and said second end being removably attached to said main shaft's first end;

a head nose piece defining a threaded bore therein, said head nose piece's bore being aligned in the same plane with said barrel cartridge's tapered bore, and said nose piece being integrally attached to said first head ball;

a tube-shaped barrel defining a bore therethrough, said barrel's bore being aligned in the same plane with said head nose piece's bore;

a first washer defining an aperture therethrough, said first washer's aperture being aligned in the same plane with said barrel bore, and said first washer being positioned between said barrel and said head nose piece;

a second washer defining an aperture therethrough, said second washer's aperture being aligned in the same plane with said barrel bore, and said second washer being positioned between said barrel and said barrel cartridge;

a plurality of backup rings, said backup rings encircling said barrel;

a plurality of o-rings, said o-rings encircling said barrel with each o-ring being positioned between two backup rings; and a bolt having a first end and second end, said bolt traversing said spacer's bore, cylindrical spring's bore, and said barrel cartridge's tapered bore, and said bolt's first end being attached to said head nose piece opposite said head ball.

6. The pocket billiards break shot training apparatus of claim 1 wherein said bow restraint assembly comprises:

a joining rod having a first end and a second end;

a first rod having a first end and a second end, said first rod's first end being removably attached to said joining rod's first end; and a second rod having a first end and a second end, said second rod's first end being removably attached to said joining rod's second end.

7. The pocket billiards break shot training apparatus of claim 6 further comprising:

a first stabilizing tube defining a bore therethrough, said first stabilizing tube surrounding said first rod's first end; and a second stabilizing tube defining a bore therethrough, said second stabilizing tube surrounding said second rod's first end.

8. The pocket billiards break shot training apparatus of claim 7 wherein said first rod defines a bore extending therethrough and said second rod defines a bore extending therethrough.

9. The pocket billiards break shot training apparatus of claim 8 wherein said energy absorbing assembly further comprises:

a first fastening member, said first fastening member being integrally attached to said first rod's second end;

a first extension rod, said first extension rod being shaped and dimensioned to slide in and out of said first rod's bore at said first rod's second end;

a second fastening member, said second fastening member being integrally attached to said second rod's second end; and a second extension rod, said second extension rod being shaped and dimensioned to slide in and out of said second rod's bore at said second rod's second end.

10. A pocket billiards break shot training apparatus comprising:

a cross-shaped frame having a main shaft and a lateral shaft, said main shaft having a first end and a second end and defining a lateral bore therethrough, and said lateral shaft having a first end and a second end and extending through said main shaft's lateral bore;

an energy absorbing assembly, said energy absorbing assembly being removably attached to said main shaft's first end;

a head ball having a generally spherical outer surface, said head ball being integrally attached to said energy absorbing assembly, opposite said main shaft;

a rear ball having a generally spherical outer surface, said rear ball being integrally attached to said main shaft's second end;

a first side ball having a generally spherical outer surface and defining a bore therethrough;

a second side ball having a generally spherical outer surface and defining a bore therethrough;

a bow restraint assembly; and a restraining cord, said restraining cord's first end being removably attached to said bow restraint assembly, said restraining cord's second end being removably attached to said bow restraint assembly opposite said restraining cord's first end, and said restraining cord extending through said first side ball, said lateral shaft, and said second side ball.

11. The pocket billiards break shot training apparatus of claim 10 further comprising:

a center ball having a generally spherical shape and defining a first bore and second bore therethrough, said first bore surrounding said main shaft between said main shaft's first and second ends, and said second bore surrounding said lateral shaft between said lateral shaft's first and second ends.

12. The pocket billiards break shot training apparatus of claim 10 wherein said head ball is yellow and carries the numeral "1" and said rear, first side, and second side balls are black.

13. The pocket billiards break shot training apparatus of claim 10 wherein said energy absorbing assembly comprises:

an alignment cartridge having a first end and second end and defining a tapered bore therethrough, said tapered bore having a first diameter at said first end and a second diameter at said second end, said tapered bore having a third diameter between said first and second diameters, said first diameter being smaller than said second diameter, said third diameter being smaller than said first diameter, and said second end being removably attached to said main shaft's first end;

a spacer defining a threaded bore therethrough, said spacer's bore being aligned in the same plane with said alignment cartridge's tapered bore;

a cylindrical spring having a first end and a second end and defining a bore therethrough, said cylindrical spring's bore being aligned in the same plane with said spacer's bore, said cylindrical spring's first end being adjacent to said spacer, and said cylindrical spring's second end being adjacent to said alignment cartridge's first end; and a bolt having a first end and second end, said bolt traversing said spacer's bore, cylindrical spring's bore, and said alignment cartridge's tapered bore, and said bolt's first end being attached to said head ball.

14. The pocket billiards break shot training apparatus of claim 10 wherein said energy absorbing assembly comprises:

a barrel cartridge having a first end and second end and defining a tapered bore therethrough, said bore having a first diameter at said first end and a second diameter at said second end, said first diameter being smaller than said second diameter, and said second end being removably attached to said main shaft's first end;

a head nose piece defining a threaded bore therein, said head nose piece's bore being aligned in the same plane with said barrel cartridge's tapered bore, and said nose piece being integrally attached to said first head ball;

a tube-shaped barrel defining a bore therethrough, said barrel's bore being aligned in the same plane with said head nose piece's bore;

a first washer defining an aperture therethrough, said first washer's aperture being aligned in the same plane with said barrel bore, and said first washer being positioned between said barrel and said head nose piece;

a second washer defining an aperture therethrough, said second washer's aperture being aligned in the same plane with said barrel bore, and said second washer being positioned between said barrel and said barrel cartridge;

a plurality of backup rings, said backup rings encircling said barrel;

a plurality of o-rings, said o-rings encircling said barrel with each o-ring being positioned between two backup rings; and a bolt having a first end and second end, said bolt traversing said spacer's bore, cylindrical spring's bore, and said barrel cartridge's tapered bore, and said bolt's first end being attached to said head nose piece opposite said head ball.

15. The pocket billiards break shot training apparatus of claim 10 wherein said bow restraint assembly comprises:

a joining rod having a first end and a second end;

a first rod having a first end and a second end, said first rod's first end being removably attached to said joining rod's first end; and a second rod having a first end and a second end, said second rod's first end being removably attached to said joining rod's second end.

16. The pocket billiards break shot training apparatus of claim 15 further comprising:

a first stabilizing tube defining a bore therethrough, said first stabilizing tube surrounding said first rod's first end; and a second stabilizing tube defining a bore therethrough, said second stabilizing tube surrounding said second rod's first end.

17. The pocket billiards break shot training apparatus of claim 16 wherein said first rod defines a bore extending therethrough and said second rod defines a bore extending therethrough.

18. The pocket billiards break shot training apparatus of claim 17 wherein said energy absorbing assembly further comprises:

a first fastening member, said first fastening member being integrally attached to said first rod's second end;

a first extension rod, said first extension rod being shaped and dimensioned to slide in and out of said first rod's bore at said first rod's second end;

a second fastening member, said second fastening member being integrally attached to said second rod's second end; and a second extension rod, said second extension rod being shaped and dimensioned to slide in and out of said second rod's bore at said second rod's second end.

19. A pocket billiards break shot training apparatus comprising:

a cross-shaped frame having a main shaft and a lateral shaft, said main shaft having a first end and a second end, said lateral shaft having a first end and a second end, and said lateral shaft being integrally attached to and perpendicularly aligned with said main shaft;

a head ball having a generally spherical outer surface, said head ball being integrally attached to said main shaft's first end;

a rear ball having a generally spherical outer surface, said rear ball being integrally attached to said main shaft's second end;

a first side ball having a generally spherical outer surface, said first side ball being integrally attached to said lateral shaft's first end;

a second side ball having a generally spherical outer surface, said second side ball being integrally attached to said lateral shaft's second end;

an bow restraint assembly;

a first restraining cord, said first restraining cord being removably attached to said bow restraint and integrally attached to said first side ball; and a second restraining cord, said second restraining cord being removably attached to said bow restraint opposite said first restraining cord, and said second restraining cord being integrally attached to said second side ball.

20. The pocket billiards break shot training apparatus of claim 19 wherein said bow restraint assembly comprises:

a joining rod having a first end and a second end;

a first rod, said first rod being removably attached to said joining rod's first end; and a second rod being removably attached to said joining rod's second end.

* * * * *